US005186189A

United States Patent [19]

Harris

[11] Patent Number: 5,186,189

[45] Date of Patent: Feb. 16, 1993

[54] FINGER NAIL POLISH PROTECTOR

[76] Inventor: Pauline Harris, B-1 Cornwallis Ct., Durham, N.C. 27707

[21] Appl. No.: 792,419

[22] Filed: Nov. 15, 1991

[51] Int. Cl.[5] ..... A45D 29/00

[52] U.S. Cl. ..... 132/285; 2/21

[58] Field of Search ..... 132/73, 73.5, 285, 319, 132/320, 333; 2/21

[56] References Cited

U.S. PATENT DOCUMENTS

| | | | |
|---|---|---|---|
| 1,486,006 | 3/1924 | Blom | 132/73 |
| 2,179,046 | 11/1939 | Lewis | 2/21 |
| 2,251,551 | 8/1941 | O'Reilly | 2/21 |
| 2,323,854 | 7/1943 | Silverman | 2/21 |
| 2,335,320 | 11/1943 | Swietek | 132/73 |
| 2,458,709 | 1/1949 | Kayer | 2/21 |
| 2,487,101 | 11/1949 | Colby et al. | 2/21 |
| 2,546,619 | 3/1951 | Turner | 2/21 |
| 3,967,631 | 7/1976 | Kosal | 132/73 |
| 4,089,066 | 5/1978 | Dethman | 2/21 |
| 4,694,843 | 9/1987 | Casenhiser | 132/73 |
| 4,966,174 | 10/1990 | Stanczak | 2/21 |
| 4,972,857 | 11/1990 | Stewart et al. | 132/73 |
| 4,984,592 | 1/1991 | Hellein | 132/285 |
| 5,031,608 | 7/1991 | Weinstein | 2/21 |

*Primary Examiner*—Gene Mancene
*Assistant Examiner*—Frank A. LaViola
*Attorney, Agent, or Firm*—Olive & Olive

[57] ABSTRACT

The fingernail polish protector of the invention has a finger-encircling piece, elongated pieces extending in parallel from opposing sides of the finger-encircling piece, an upper piece hinged to one of the elongated pieces and latchable to the other elongated piece, and at least one lower finger-retaining portion extending downward between said finger encircling piece and the distal end of said elongated piece. The fingernail polish protector may also include an upper finger-retaining portion extending upward from an elongated piece. The protector may be attached to open ends of the fingers of a glove.

7 Claims, 2 Drawing Sheets

FINGER NAIL POLISH PROTECTOR

BACKGROUND OF THE INVENTION

1. Field of the Invention

This invention relates to a protector for fingernails after nail polish has been applied.

2. Description of the Related Art

Persons who apply fingernail polish to their fingers or who have fingernail polish applied during a manicure must allow the polish to dry before handling or touching objects. Because fingernail polish remains tacky for a considerable time, people with newly polished fingernails often find that they must use their fingers before the polish is completely dry, or they find themselves inadvertently brushing one or more fingers against an object, resulting in defacing of the smooth polish finish, and possibly necessitating removal of the polish and recoating with a new layer of polish.

A number of fingernail protectors have been designed to prevent marring or scratching of freshly applied or tacky fingernail polish. For example, the fingernail cap of Kosal (U.S. Pat. No. 3,967,631) has a closed tip completely encasing the nail and fingertip and a longitudinal slit to allow the cap to conform to a fingertip. Other elongated tubular protectors are disclosed in U.S. Pat. Nos. 4,908,881; 4,960,138; and 4,972,857.

The fingernail protector of Dethman (U.S. Pat. No. 4,089,066) has a finger support flange, a strap connected to a semicircular shell and a semicircular cover defining a cylinder and hinged together to cover the fingernail area. The fingernail protector of Stanczak (U.S. Pat. No. 4,966,174) has an upper and a lower shell secured together at their forward ends and latch means of rigid latch rods.

Each of the above fingernail protectors covers the lower portion of the fingertip so that it is difficult to use the fingertip. The patent of Jefferson (U.S. Pat. No. 4,665,934) has a removable U-shaped recess for insertion of the nail but leaves the lower fingertip free.

Except for the fingernail protector of Stanczak, these fingernail protectors appear to allow inadvertent touching of the interior of the protector with the polished surface of the nail by movement of the fingertip. These protectors also must be individually placed on the fingers.

It is therefore an object of this invention to provide a fingernail polish protector which has an open position for application of fingernail polish and a closed position for protection of the polished nail, which allows movement of the fingertip without damage to the polish and allows us of the lower fingertip surface while the finger is in the protector.

It is a further object of this invention to provide a glove means for donning multiple protectors prior to application of the fingernail polish.

Other objects and advantages will be more fully apparent from the following disclosure and appended claims.

SUMMARY OF THE INVENTION

The fingernail polish protector of the invention comprises:

(a) a finger-encircling piece;

(b) a first elongated piece and a second elongated piece, said elongated pieces extending in parallel from opposing sides of said finger-encircling piece, each of said elongated pieces having a distal portion;

(c) an upper piece defining an inner finger-nail receiving space, said upper piece hinged to the distal portion of said first elongated piece and latchable to said second elongated piece; and (d) at least one lower finger-retaining portion extending downward from at least one elongated piece between said finger encircling piece and the distal end of said elongated piece;

wherein a finger having in sequence a distal end, a fingernail, a first joint and a second joint may be positioned in said protector with the finger-encircling piece between the first and second joints, the upper piece over the fingernail, and the lower finger retaining portion beneath the finger between the distal end and the first joint.

The upper piece may be rounded in parallel with a fingernail or may have a flattened elongated central portion with an edge piece extending downward along each side when the upper piece is closed over the finger.

The fingernail polish protector may also comprise an upper finger-retaining portion extending upward from an elongated piece, so that when the fingernail polish protector is positioned on said finger, the upper finger retaining portion is above the finger between the fingernail and the first joint and holds the finger below the upper piece.

The invention further comprises a glove having one or more of the fingernail polish protectors attached thereto.

Other aspects and features of the invention will be more fully apparent from the following disclosure and appended claims.

DETAILED DESCRIPTION OF THE INVENTION AND PREFERRED EMBODIMENTS THEREOF

As shown in FIGS. 1–9, the fingernail polish protector 18 of the invention herein comprises a finger-encircling piece 20 which may be a complete circle, as shown, adjusted to fit tightly on the desired portion of a finger to maximize security on the finger, but may alternatively be a partial circle extending either over the top or under the bottom of the finger and including the sides of the finger, being similar, for example, to the gripping portion on a banjo finger pick.

Preferably the finger-encircling piece 20 is a fat band or strip, and preferably if less than a full circle is made of a resilient or bendable material that allows it to open to receive the finger and then closes or is closable firmly on the finger.

Figure 1:
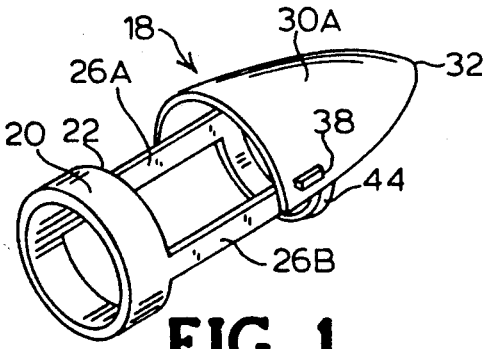
FIG. 1 is a perspective view of a first side of a closed protector having a curved upper piece according to the first embodiment of the invention.
Figure 2:
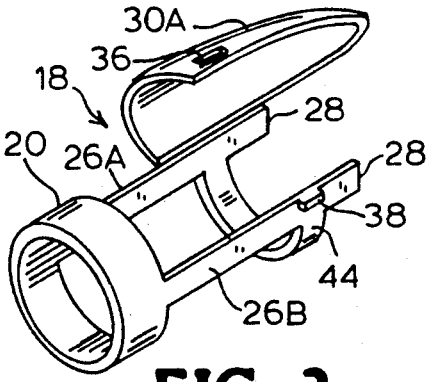
FIG. 2 is a perspective view of a first side of an opened protector of the embodiment of FIG. 1.
Figure 3:
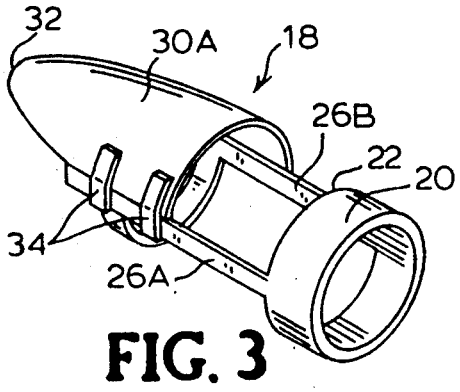
FIG. 3 is a perspective view of a second side of a closed protector according to the first embodiment of the invention.
Figure 4:
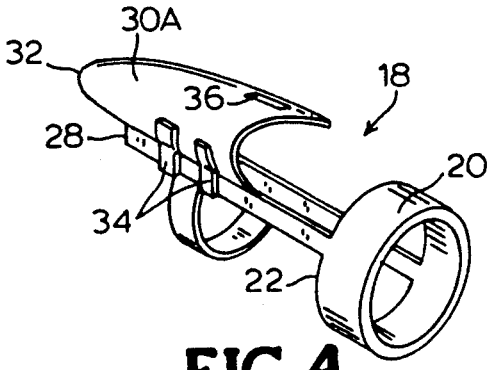
FIG. 4 is a perspective view of a second side of an opened protector of the embodiment of FIG. 1.
Figure 5:
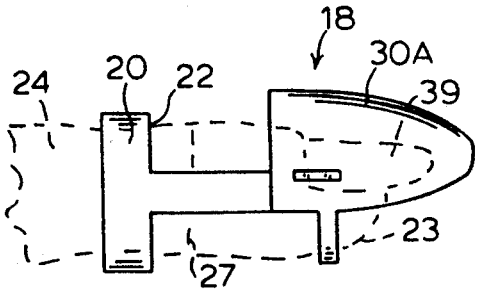
FIG. 5 is a side perspective view of the first embodiment in an open position on a finger.
Figure 6:
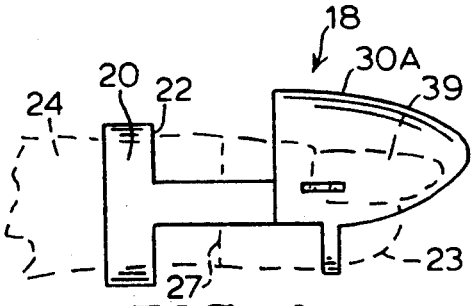
FIG. 6 is a side perspective view of the first embodiment in an closed position on a finger.
Figure 7:
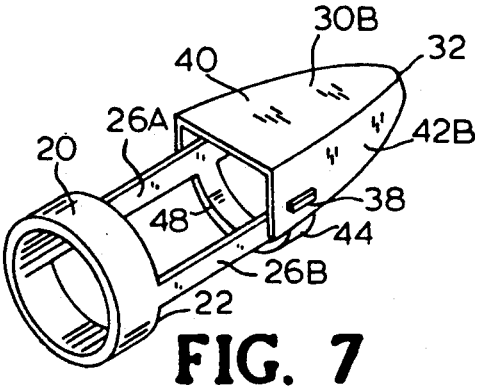
FIG. 7 is a side perspective view of a second embodiment of the invention having an angular upper piece.

The finger-encircling piece 20 has a front edge 22 which faces the fingertip 23 when the protector 18 is placed on a finger 24 (FIG. 5). An elongated piece 26A,B extends from the front edge 22 toward the fingertip 23 on each side of the finger-encircling piece 20. Preferably the length of each elongated piece 26A,B is at least long enough to least extend to midway between the fingertip 23 and the first finger joint 27. Preferably the distal tip 28 of the elongated piece 26 does not extend beyond the fingertip 23.

One upper piece 30A or 30B (shown as 30A) is hinged to first elongated piece 26A and generally extends beyond the distal end 28 of the elongated pieces 26A,B in the form of a pointed tip 32. The upper piece 30A or 30B may be made in various lengths for persons with different fingernail lengths. The hinge means 34 may be any known in the art such as small hinges welded or otherwise attached, a flexible junction piece which may be formed integrally with the elongated piece 26A, and the like. The hinge means 34 allows the upper piece 30A,B to be tipped back away from the finger 24 as shown in FIGS. 2, 4–5 and 8–9 or to be brought in a closed position over the finger 24 as shown in FIGS. 1, 3 and 6–7. The hinge mechanism may allow for detachment of the upper piece 30A,B so that the upper piece 30 A,B may be removable from first elongated piece 26A, for example, if a shorter or longer upper piece 30A,B is desired. The means of detachment may be any known in the art, for example, the upper piece may be slidably or otherwise releasably attachable to the hinge or the means of attachment on the hinge side may be similar to the lock mechanisms discussed below. Although shown in the Figures herein as being hinged on the left side when viewed from the hand, it is clear that the mirror image hinge arrangement is also contemplated by the invention and within its scope.

The upper piece 30A,B has a lock mechanism 36 to allow the upper piece 30A,B to be reversibly locked to a second lock mechanism 38 on the second elongated piece 26B. Lock mechanisms 36, 38 may comprise a slot and protrusion as shown herein or may be any easily manufactured, easily locked and unlocked system known in the art.

In the first embodiment (FIGS. 1–6), the upper piece 30A is rounded and is shaped generally to parallel the shape and curvature of the fingernail 39 covered by the upper piece 30A. It thus provides a complete cover for the nail 39.

In the second embodiment (FIGS. 7 and 9) the upper piece 30B has a flat elongated central portion 40 extending at least the length of the fingernail. The central portion 40 preferably is pointed at the end. Extending generally perpendicularly along each side of the elongated central portion are edge pieces 42A,B. The first edge piece 42A is hinged to the first elongated piece 30A. The second edge piece 42B bears a lock mechanism 36 to fasten to lock mechanism 38 on the second elongated piece 30B.

Figure 8:
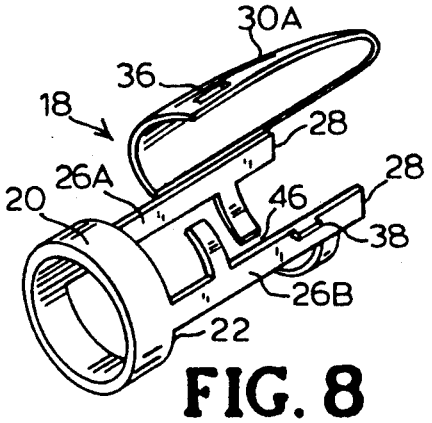
FIG. 8 is a side perspective view of the first embodiment having an upper finger-retaining piece.

A lower finger-retaining portion 44 extends downward (on the opposite side as the upper piece 30A,B) from at east one of the elongated portions 30A,B. As shown in FIG. 8, a lower finger-retaining portion 44 may extend from each elongated portion 30 A,B in a downward curve with a gap 46 formed between the ends of the two finger-retaining portions 44. A gap 46 of a size a quarter or a third the width of the finger allows the finger to be removed more easily while still holding the finger in the protector 18 when not using the protector 18 to protect the nail. Alternatively, the lower finger-retaining portion 44 may extend all the way around the finger 24 as shown in FIGS. 1–5. The lower finger-retaining portion 44 may be a narrow portion or band 48 (FIGS. 1–5) or alternatively, may be a wider portion or band 50 (FIG. 9).

In any case, the lower finger-retaining portion 44 is located sufficiently behind the lower portion of the fingertip 33 so that a person having the protector 18 on one or more fingers may use these fingertips in a normal manner, for example, to key in a telephone number on a touch-tone phone or to type.

In addition, the lower finger-retaining portion 44 should be positioned so that it is between the fingertip 23 and the first joint 27 so that movement of the fingertip is within the lower finger-retaining portion. The lower finger-retaining portion 44 should not extend across the lower portion of the first joint 27 so that movement of the fingertip 23 is possible.

Figure 9:
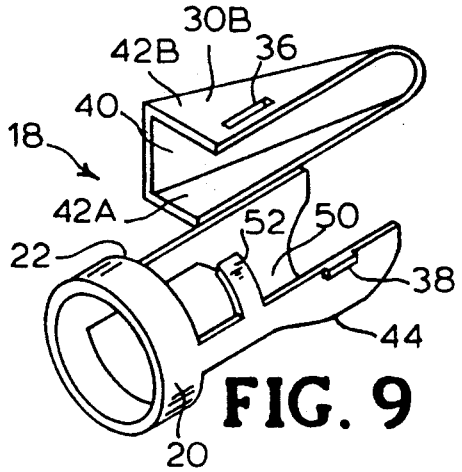
FIG. 9 is a side perspective view of the second embodiment having an upper finger-retaining piece and an extended bottom piece.
Figure 10:
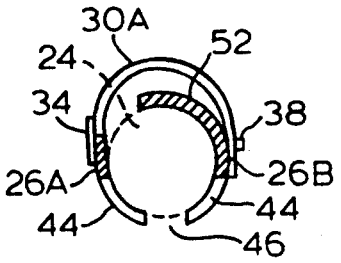
FIG. 10 is a cross-section of a fingernail polish protector having an upper finger-retaining piece according to the invention.

Each of the embodiments of the invention discussed above preferably also has an upper finger-retaining portion 52 as shown in FIGS. 8–10 not shown in other Figures to simplify them). The upper finger-retaining portion 52 may be located beneath the upper piece 30A,B or may be between the upper piece 30A,B and the finger-encircling piece 20 and holds the finger 24 beneath and separate from the upper piece 30A,B, when the upper piece 30A,B is closed over the finger 24. In any case, the upper finger-retaining portion 52 is positioned between the nail 39 and the first finger joint 27 along either or both of the elongated pieces 30A,B, does not extend over the nail 39, and is bent in position so that the fingertip 23 is held lower than the upper piece 30A,B when the upper piece 30A,B is closed over the fingernail 39 as shown in cross-section in FIG. 10. This position is important in keeping the upper piece 30A,B, when closed, from touching the fingernail 39.

Figure 11:
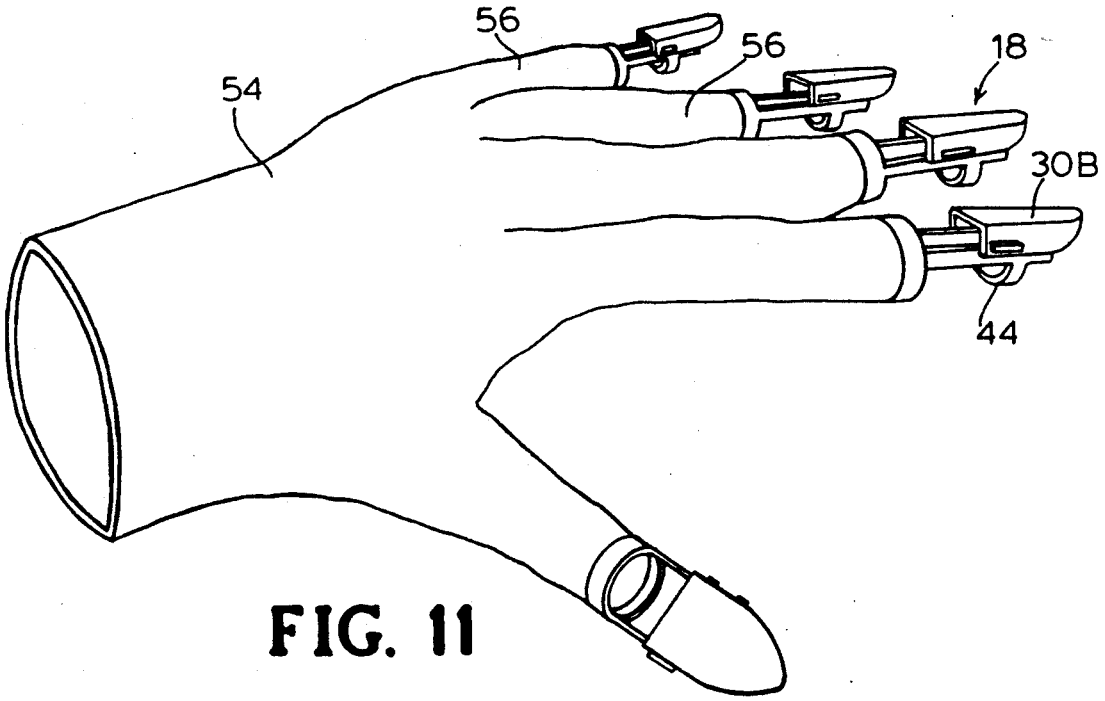
FIG. 11 is a perspective view of a glove having protectors at the finger tips.

The fingernail polish protector 18 of the invention may be attachable to, attached to, or integrally formed with a glove 54 (FIG. 11). Thus the finger-encircling piece 20 may be glued, cemented, sewed, strapped on or into, or otherwise attached to opened digital end of a glove finger 56. Alternatively the finger-encircling piece 20 may be integral with the glove finger 56 and the elongated pieces 26 A,B may be attached to the glove 54 by means known in the art. When the upper finger-retaining portion 52 is attached to a glove 54, the glove 54, may extend all the way to the upper finger-retaining portion 52 (i.e., to the area between the nail and the first finger joint) so that shortened elongated pieces extending toward the fingertip from the upper flange-retaining portion 52. It is important however that the glove finger 56 not extend far beyond the first finger joint 27 so that there is room for the upper piece 30 A,B, hinge means 34, and lock mechanisms 36, 38 to be placed as discussed above.

The fingernail polish protector 18 of the invention is preferably molded of a sturdy flexible plastic or metal material, such as in the manner of flange picks used for playing stringed instruments or in other finger-gripping items.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention. It is particularly understood that the various embodiments of the components of the invention, for example, the upper piece embodiments, the various lower and upper finger-retaining portions and the attachments to a glove, may be combined in ways not specifically discussed.

What is claimed is:

1. A fingernail polish protector for a finger having in sequence a distal end, a lower fingertip and an upper fingernail, a first joint and a second joint, said protector comprising:

(a) a finger-encircling piece;

(b) a first elongated piece and a second elongated piece, said elongated pieces extending in parallel from opposing sides of said finger-encircling piece, each of said elongated pieces having a distal portion;

(c) an upper piece defining an inner fingernail receiving space, said upper piece hinged to the distal portion of said first elongated piece and latchable to said second elongated piece;

(d) at least one lower finger-retaining portion extending downward from at least one elongated piece between said finger encircling piece and the distal end of said elongated piece;

wherein said protector is formed so that when said finger-encircling piece is placed between the first and second joints of the finger, the upper piece extends over the fingernail, the lower finger-retaining portion is beneath the finger between the distal end and the first joint behind the fingertip, and the lower finger tip extends beyond the finger-retaining portion.

2. A fingernail polish protector according to claim 1, wherein the upper piece is rounded in parallel to a finger nail placed in the protector.

3. A fingernail polish protector according to claim 1, wherein the upper piece comprises an elongated flat central portion having two sides, and an edge piece extending along each side.

4. A fingernail polish protector according to claim 1, further comprising an upper finger-retaining portion extending upward from an elongated piece, wherein when the fingernail polish protector is positioned on said finger, the upper finger retaining portion is above the finger between the fingernail and the first joint, and the upper finger-retaining portion holds the fingernail beneath and separate from the upper piece.

5. A fingernail polish protector according to claim 1, wherein the finger-encircling piece is positioned at an open finger end of a glove.

6. A glove for use in protecting fingernails on fingers, each of which fingers has in sequence a distal end, a lower fingertip and an upper fingernail, a first joint and a second joint, said glove comprising:

(a) a hand piece comprising a wrist piece integrally jointed with finger pieces having circular open distal ends;

(b) fingernail polish protectors attached to said open distal ends, each of said fingernail polish protectors comprising:

(i) a first elongated piece and a second elongated piece, said elongated pieces extending in parallel from opposing sides of a said circular open end, each of said elongated pieces having a distal portion;

(ii) an upper piece defining an inner fingernail receiving space, said upper piece hinged to the distal portion of said first elongated piece and latchable to said second elongated piece; and (iii) a lower finger-retaining portion extending downward from at least one elongated piece;

wherein each of said protectors is formed so that when said fingers are positioned in the glove, and each of said fingers is positioned in a finger piece and protector, each upper piece is placed over a fingernail, the lower finger-retaining portion is positioned beneath the finger between the distal end and the first joint behind the fingertip, and the lower finger tip extends beyond the finger piece and protector.

7. A glove according to claim 6, further comprising an upper finger-retaining portion extending upward from an elongated piece, wherein when the fingernail polish protector is positioned on said finger, the upper finger retaining portion is above the finger between the fingernail and the first joint and the upper finger-retaining portion holds the fingernail beneath and separate from the upper piece.

* * * * *